United States Patent [19]

Marx

[11] 4,293,982

[45] Oct. 13, 1981

[54] TOOL FOR OPENING UP FIBER BALES

[75] Inventor: Herr J. Marx, Monchen-Gladbach, Fed. Rep. of Germany

[73] Assignee: Trutzschler GmbH & Co. KG, Monchen-Gladbach, Fed. Rep. of Germany

[21] Appl. No.: 133,398

[22] Filed: Mar. 24, 1980

[30] Foreign Application Priority Data

Apr. 27, 1979 [DE] Fed. Rep. of Germany ..... 2917122

[51] Int. Cl.[3] ..... D01G 7/06

[52] U.S. Cl. ..... 19/80 A; 241/101 A

[58] Field of Search ..... 83/663, 664, 665, 672, 83/676; 19/80 R, 81, 145.5; 241/101 A

[56] References Cited

U.S. PATENT DOCUMENTS 3,066,878 12/1962 Wildbolz ..... 19/80 R
3,192,571 7/1965 Halleux ..... 19/80 R
4,240,182 12/1980 Leifeld et al. ..... 19/81

FOREIGN PATENT DOCUMENTS 2037830 7/1980 United Kingdom ..... 19/80 R
2037831 7/1980 United Kingdom ..... 19/80 R

*Primary Examiner*—Louis Rimrodt
*Attorney, Agent, or Firm*—Haseltine and Lake

[57] ABSTRACT

A tool for opening fiber bales in which a plurality of axially spaced blades are mounted coaxially on a shaft. Each of the blades has a periphery provided with projecting sawteeth which engage the fibers of a bale to be opened. Each of the sawteeth is bounded by two flanks which include a predetermined angle between themselves. There is also a predetermined circumferential spacing between the tips of successive fronts of the sawteeth. A leading flank and a trailing flank are arranged so that the leading flank is inclined in the direction of rotation. The angle of inclination of the leading flank with reference to a straight-line intersecting the tip of the respective tooth and to the axis of rotation of the shaft, is smaller than a predetermined angle. The tips of the sawteeth may face forwardly in the direction of rotation of the shaft.

10 Claims, 3 Drawing Figures

TOOL FOR OPENING UP FIBER BALES

BACKGROUND OF THE INVENTION

The present invention relates to a tool for opening up fiber bales.

Loose fibers are usually stored and shipped in form of strongly compressed bales which must be opened up before the fibers can be subjected to a subsequent manufacturing operation, such as cleaning, carding, or the like. It is known to use for this purpose a tool in form of a roller having a shaft that can be rotated by a suitable drive, and which carries axially spaced blades having saw teeth on their periphery. These saw teeth extend from above between the interstices of a grid and engage fibers of the bale to remove them from the bale. A known tool of this type has its saw tooth blades arranged so that they tumble i.e. they are mounted on the shaft at an angle which differs by 90° with reference to the axis of rotation. The removal of fibers from the bale takes place in the entire zone between the bars of the grid, and the purpose of the tumbling arrangement is to increase productivity per unit of time. However, the tips of successive teeth on each blade of this known roller have a rather small spacing and the height of the teeth is also small. This means that the distance between the leading and trailing flanks of circumferentially adjacent teeth is also relatively small, with the result that in practical operation only a low rate of production can be achieved.

SUMMARY OF THE INVENTION

Accordingly, it is an object of this invention to avoid the disadvantages of the prior art.

A more particular object of the invention is to provide an improved tool for opening up fiber bales which provides for a significantly increased productivity rate as compared to the prior art.

In keeping with these objects, and with others which will become apparent hereafter, one feature of the invention resides in a tool for opening up fiber bales which, briefly stated, comprises a shaft adapted to be driven in rotation about an axis; and a priority of steady spaced blades coaxially mounted on the shaft for rotation therewith and each having a periphery provided with projecting sawteeth adapted to engage the fibers of a fiber bale. According to the invention the saw teeth are mounted by two flanks which include between themselves an angle of 20°–70° and the circumferential spacing between the tips of successive flanks of the saw teeth is between 60 and 180 mm.

The angle between the saw tooth flanks is identified with $\alpha$, and constitute the angle between the leading flank and the trailing flank of the respective saw tooth, which is a measure of the width of the base of the saw tooth.

The spacing between the tips of the successive saw teeth is a measure for the gap between the teeth.

The saw tooth inclination angle $\beta$ is the angle between the leading saw tooth flank and the diameter of the blade and also provides a measure for the sawtooth height.

The combination of the flank angle and the tooth tip spacing according to the invention assures that the tool according to the invention has teeth with a relatively wide base and substantial gap between successive teeth, so that room is provided for entrainment of many fibers from the bale. This produces a very significantly increased rate of production, even if the fibers of the bale are relatively small.

It is preferred if the angle $\alpha$ is between 25° and 40° and if the spacing between successive tooth tips is between 80 and 140 mm. The angle $\beta$ is preferably smaller than 50°, advantageously smaller than 45°, since this effectively prevents the formation of fiber windings about the teeth. The height of the teeth is advantageously between 20–25 mm so as to assure that the teeth can enter to a satisfactory depth into the surface of the fiber bale. An effective entry into the bale is particularly supported by the fact that according to a further feature of the invention the tips of the teeth face forwardly in the direction of rotation. The leading flank of each tooth is advantageously concavely curved, since this measure further increases the size of the gap between successive teeth and thus the quantity of fibers that can be entrained in such a gap.

A further advantageous measure is for the tips of each blade to be offset circumferentially with reference to the tips of axially adjacent blades. This measure prevents two or more teeth from simultaneously entering into the surface of the bale and setting up undue vibrations in the tool or causing other problems. It is particularly preferred if all of the tips of the teeth of the tool are located on an imaginary helix which surrounds the shaft with radial spacing, because in such a construction the teeth engage individually and successively in the surface of the fiber bale, which greatly facilitates a quiet uniform rotation of the tool.

The rotational velocity of the tool is preferably between 17 m/sec and 22 m/sec.

The invention we have here would have to be described with reference to two exemplary embodiments. However, it should be understood that these are for purposes of explanation only.

DESCRIPTION OF PREFERRED EMBODIMENTS

Figure 1:
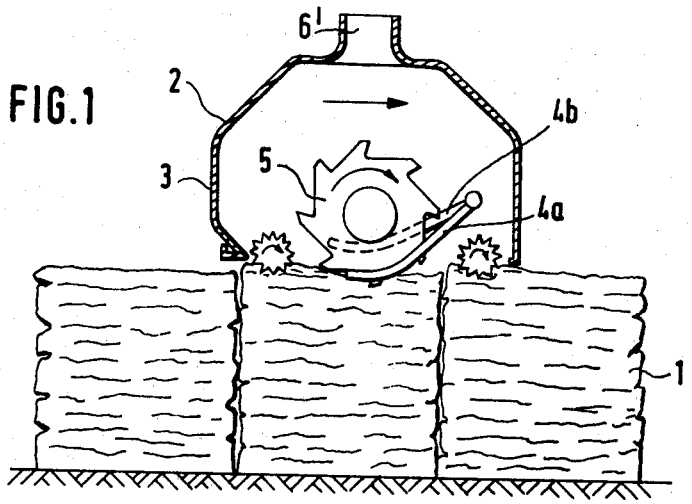
FIG. 1 is an end view of a tool according to the present invention, engaged in the process of opening up a fiber bale.
Figure 2:
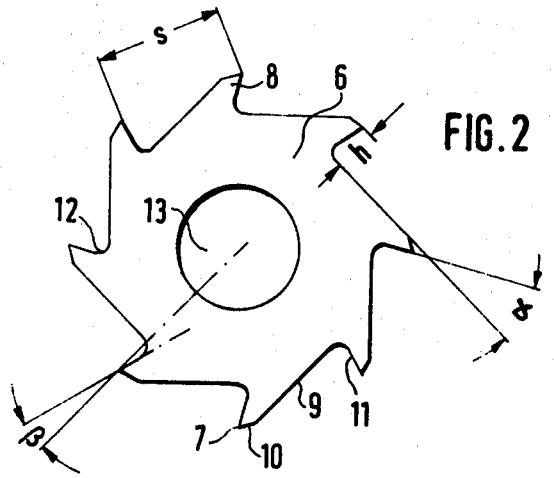
FIG. 2 is an end elevational view of a single toothed blade of the tool in FIG. 1.

Referring firstly to the embodiment in FIGS. 1 and 2 it will be seen that reference numeral No. 1 identifies successively arranged fiberous bales which are to be opened up, i.e. from which the compressed fibers are to be removed. Arranged for movement above the fiber bales 1 is a device for opening up the fiber bales, which moves in the direction of the straight-line arrow as illustrated. This device is identified with reference numeral 2 and includes a housing 3 and a plurality of successively arranged bars 4*a*, 4*b* which form between themselves a grid. Also provided is a tool 5 according to the invention and an aspirating tube 6. The tool 5 rotates in the direction indicated by the curved arrow, i.e. in the same direction in which the device 2 advances as indicated by the straight-line arrow.

The tool 5 is composed of a shaft 14 (see FIG. 3) on which there is mounted a plurality of axially spaced blades 6 as shown in FIG. 2. These blades are mounted on the shaft 14 so that they can rotate with it but not relative to it, in a manner known per se to those skilled in the art. The blades 6 are provided with circumferentially spaced teeth projecting from its periphery and each having a leading flank and a trailing flank (as considered with reference to the direction of rotation) which include between each other an angle $\alpha$ that amounts, in the illustrated embodiment, to 30° to it. The angle of inclination of the teeth is identified with character $\beta$ and amounts in this particular instance to 15°. The teeth 8 have tips 7 which face forwardly in the direction of rotation of the respective blade 6 and the trailing flanks 9 merge with the teeth 7 via a short inclined portion 10. A concave recess 12 is provided between the leading flank 11 and the trailing flank 9 of the next tooth; this increases the size of the gap between consecutive teeth and thus the space in which fibers can be entrained. The center of each blade 6 is provided with an opening 13 in which the shaft 14 is receivable.

Figure 3:
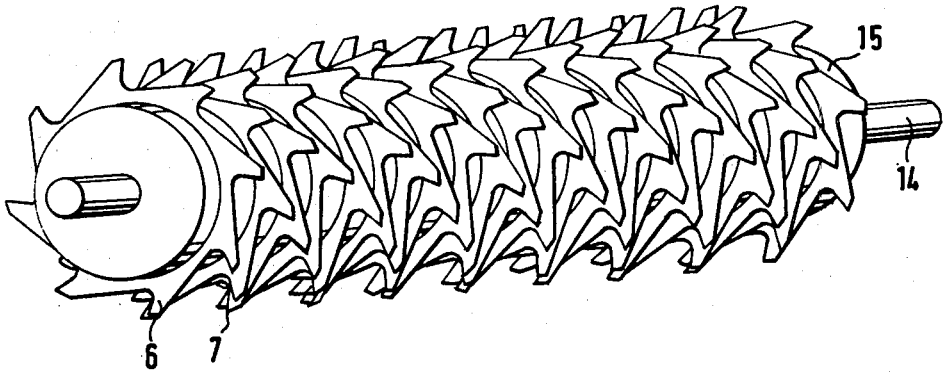
FIG. 3 is a perspective view illustrating a further embodiment of the invention.

FIG. 3 shows a further embodiment of the invention which corresponds in most particulars to the one in FIGS. 1 and 2, so that no further description will be given with reference to the features that are the same as in FIGS. 1 and 2. The embodiment in FIG. 3, however, is so constructed that the tip 7 of the teeth of all of the blades 6 are located on an imaginery helix which surrounds the shaft 14 with radial clearance, so that the teeth enter successively and individually into the bales 1 (see FIG. 1) and a steady, quiet and uniform rotation of the tool is assured. Successive flanks of the blades 6 are separated from one another by spaces 15 so that the axial spacing between them is maintained.

The invention has been described hereinabove with reference to two exemplary embodiments. It should be understood, however, that various changes and modifications will offer themselves to those skilled in the art and that all such changes and modifications are therefore intended to be encompassed within the scope of protection of the appended claims.

I claim:

1. A tool for opening up fiber bales, comprising a shaft adapted to be driven in rotation about an axis; and a plurality of axially spaced blades coaxially mounted on said shaft for rotation therewith and each having a periphery provided with projecting sawteeth adapted to engage the fiber of a fiber bale, each of said sawteeth being bounded by two flanks which include between themselves an angle of 20°–70° and the circumferential spacing between the tips of successive fronts of said sawteeth being between 60–180 mm.

2. A tool as defined in claim 1, wherein said angle is between 25°–40°.

3. A tool as defined in claim 2, wherein said spacing is between 80–140 mm.

4. A tool as defined in claim 1, said two flanks including a leading flank and a trailing flank and said leading flank being inclined in the direction of rotation; and wherein the angle of inclination of said leading flank with reference to a straight line intersecting the tip of the respective sawtooth and to the axis of rotation of said shaft, is smaller than 50°.

5. A tool as defined in claim 1, wherein said sawteeth project from said periphery by a distance of 20–50 mm.

6. A tool as defined in claim 1, wherein said tips of said sawteeth face forwardly in the direction of rotation of said shaft.

7. A tool as defined in claim 1, said two flanks including a leading flank and a trailing flank as considered in the direction of rotation of said shaft; and wherein said leading flank is in part concavely curved.

8. A tool as defined in claim 1, wherein the sawtooth tips of each blade are circumferentially offset with reference to the sawtooth tips of axially adjacent blades.

9. A tool as defined in claim 8, wherein all of said tips are located on an imaginary helical line surrounding said shaft with radial spacing.

10. A tool as defined in claim 1, wherein said shaft and blades are constructed to withstand rotary operating velocities of 17–22 m/sec.

* * * * *